United States Patent [19]

Yamazoe et al.

[11] 4,099,091

[45] Jul. 4, 1978

[54] ELECTROLUMINESCENT PANEL INCLUDING AN ELECTRICALLY CONDUCTIVE LAYER BETWEEN TWO ELECTROLUMINESCENT LAYERS

[75] Inventors: Hiroshi Yamazoe, Katano; Hiroshi Kawarada, Hirakata; Hisanao Sato, Ibaragi; Nobumasa Ohshima, Hirakata, all of Japan

[73] Assignee: Matsushita Electric Industrial Co., Ltd., Japan

[21] Appl. No.: 709,529

[22] Filed: Jul. 28, 1976

[51] Int. Cl.[2] ..... H05B 33/14; H05B 33/22

[52] U.S. Cl. ..... 313/509

[58] Field of Search ..... 313/506, 509, 503

[56] References Cited

U.S. PATENT DOCUMENTS

| | | | |
|---|---|---|---|
| 2,824,992 | 2/1958 | Bouchard et al. | 313/509 |
| 2,933,602 | 4/1960 | Gillson, Jr. | 313/509 X |
| 3,014,149 | 12/1961 | Wasserman | 313/506 |
| 3,103,607 | 9/1963 | Rulon | 313/509 X |
| 3,104,339 | 9/1963 | Koury | 313/509 X |
| 3,114,066 | 12/1963 | Allen et al. | 313/509 |

*Primary Examiner*—Palmer C. Demeo

*Attorney, Agent, or Firm*—Wenderoth, Lind & Ponack

[57] ABSTRACT

An electroluminescent panel comprising a pair of electrodes having sandwiched therebetween a multi-layer comprising an insulating layer in contact with one of said electrodes, an electroluminescent layer and an intermediate layer formed from a conductive material which is in intimate contact with the electroluminescent layer but is out of contact with both of the electrodes. Due to the provision of the intermediate layer, the brightness of the electroluminescent panel can be kept high for a long time.

7 Claims, 14 Drawing Figures

ELECTROLUMINESCENT PANEL INCLUDING AN ELECTRICALLY CONDUCTIVE LAYER BETWEEN TWO ELECTROLUMINESCENT LAYERS

This invention relates to an electroluminescent panel.

A known electroluminescent (which will be simply referred to as EL hereinafter) panel comprises a pair of electrodes having a multi-layer sandwiched therebetween which comprises an insulating layer in contact with one of the electrodes and an EL layer in contact with the insulating layer at one major surface of the EL layer. The opposite major surface of the EL layer can be in direct contact with the other electrode, or a further insulating layer can be used to be inserted between the EL layer and the other electrode. At least one of the electrodes is transparent, and where an insulating layer is attached to the transparent electrode, the insulating layer is also made transparent. For the EL layer, ZnS activated with Mn or a rare earth element or other activators, for example, is used. When an electric field is applied between the electrodes, the EL layer emits lights which are emitted out of the EL panel through the transparent electrode.

This type of EL panel requires an aging process, i.e. the brightness of the virgin EL panel continues to decrease over a certain period upon application of voltage thereto. And after the aging process, the EL panel maintains a constant brightness.

Accordingly, the aging process is significant factor in producing a stable EL panel.

However, such a known EL panel is disadvantageous in that the intensity of the emitted light at a constant applied electric field decreases intensely as time passes in an aging process, i.e. the brightness of the panel decreases greatly in the aging process.

Accordingly, it is an object of this invention to provide an EL panel, the brightness of which can be maintained at a high level in an aging process.

This object is achieved according to this invention by providing an intermediate layer formed from a conductive material in intimate contact with the EL layer. The intermediate layer can be inserted in the EL layer or sandwiched between the insulating layer and the EL layer, but should not be in direct contact with either one of the electrodes. When two insulating layers which are in contact with the pair of electrodes, are used, two intermediate layers, each formed of a conductive material can be inserted between an insulating layer and the EL layer and between the other insulating layer and the EL layer, respectively. When an insulating layer or an intermediate layer is sandwiched between the EL layer and a transparent electrode through which it is intended to pass lights emitted from the EL layer to the outside of the EL panel, such insulating layer and such intermediate layer should also be transparent.

Details of this invention will become apparent from the following descriptions taken in conjunction with the accompanying drawings, in which.

Before proceeding with a detailed description of the EL panel contemplated by this invention, the structures and the features of conventional EL panels will be described hereinafter with reference to FIGS. 1 to 3. In the figures, similar elements are designated by the same reference numerals.

Figure 1:
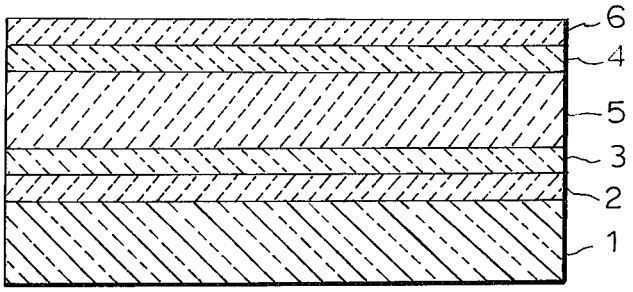
(PRIOR ART) FIG.1
FIGS. 1 to 3 are schematic cross-sectional views of conventional EL panels, respectively.

Referring to FIG. 1, reference numeral 1 designates an insulating substrate on which a first electrode 2 is provided. On the first electrode 2, a multi-layer is provided which comprises an insulating layer 3 in contact with the first electrode 2, an EL layer 5 in contact with the insulating layer 3 and a further insulating layer 4 in contact with the EL layer 5. A second electrode 6 is provided to be in contact with the further insulating layer 4.

By applying an electric field between the two electrodes, the EL layer emits lights. In the case where it is intended to cause the emitted lights to pass through the first electrode side, the insulating layer 3, the first electrode 2 and the insulating substrate 1 are made of transparent materials. If the emitted lights are desired to pass through the second electrode side, the further insulating layer 4 and the second electrode 6 are made of transparent materials.

Figure 2:
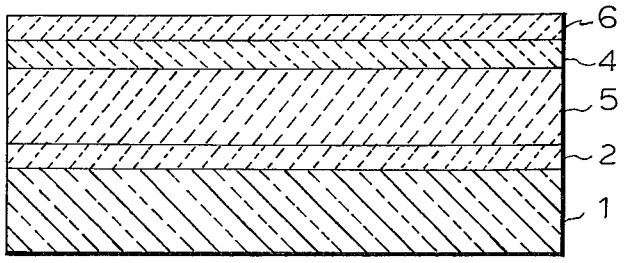
(PRIOR ART) FIG.2
Figure 3:
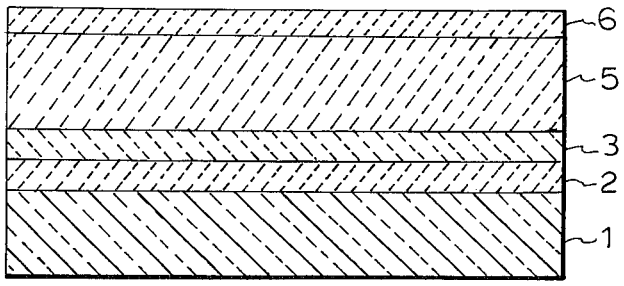
(PRIOR ART) FIG.3

Referring to FIGS. 2 and 3, the EL panels shown thereby are essentially the same as the EL panel of FIG. 1, except that the insulating layer 3 used in FIG. 1 is not used in FIG. 2, and the further insulating layer 4 used in FIG. 1 is not used in FIG. 3.

In these EL panels, ZnS plus an activator such as Mn or a rare earth element is a typical material for the EL layer. An advantage of the use of an insulating layer 3 and/or a further insulating layer 4 is that the breakdown voltage of the panel can thereby be made high. It is further advantageous therein that since the panel can be supplied with a higher voltage than a panel without such insulating layer, the panel can emit lights of higher intensity. However, a serious disadvantage of such panel is that the intensity of the emitted lights, hence the brightness of the panel, greatly decreases as working time passes, i.e. in the aging process of the panel.

This invention provides an EL panel in which the high intensity of the emitted lights, hence the high brightness of the panel, can be kept in the aging process, and accordingly, the brightness of the EL panel is much higher than that of the conventional EL panel after the aging process. The EL panel of this invention comprises a first electrode which is transparent, a second electrode and a multi-layer which is in intimate contact with and sandwiched between the electrodes, the multi-layer comprising an insulating layer in contact with one of the electrodes, an EL layer and an intermediate layer formed of a conductive material, the intermediate layer being in intimate contact with the EL layer on at least one major surface thereof and being out of contact with the above-described electrodes, whereby when the EL layer is supplied with an a.c. voltage (which can be a.c.

pulses), and the EL layer emits lights from the EL panel through the first electrode.

Figure 4:
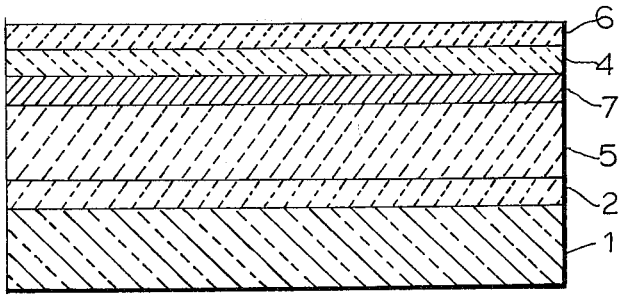
FIGS. 4 to 10 are schematic cross-sectional views of various embodiments of the EL panel of this invention.
Figure 5:
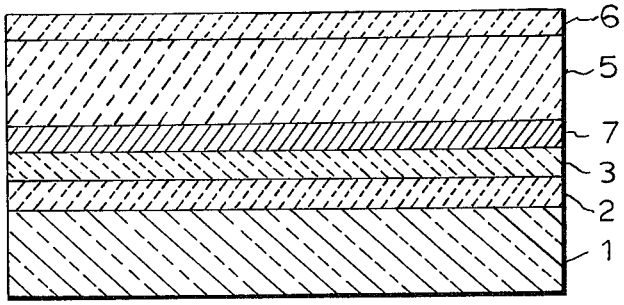

Examples of the EL panel of this invention are shown in FIGS. 4 to 10. Referring to FIG. 4, the EL panel shown therein is the same as the EL panel of FIG. 2, except that an intermediate layer 7 formed of a conductive material is provided to be sandwiched between the EL layer and the insulating layer 4. The intermediate layer 7 is in intimate contact at one major surface thereof with the EL layer 5. Referring to FIG. 5, the EL panel shown therein is the same as the EL panel of FIG. 3, except that an intermediate layer 7 formed of a conductive material is sandwiched between the EL layer and the insulating layer 3. One major surface of the intermediate layer 7 is in intimate contact with the EL layer 5.

Figure 6:
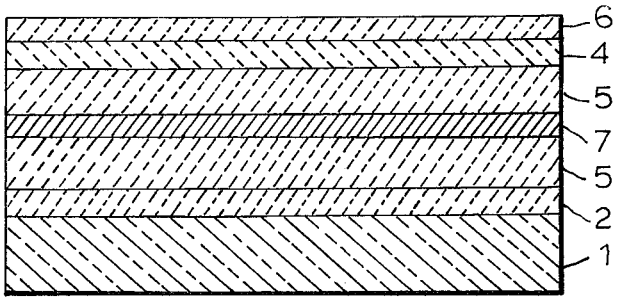
Figure 7:
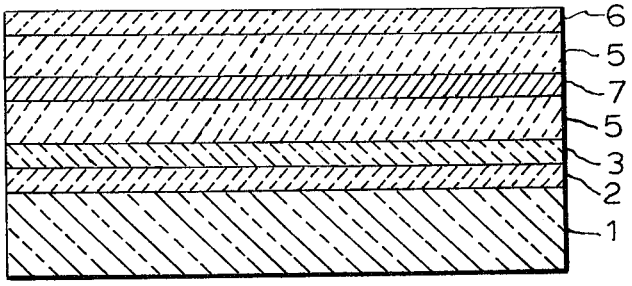

Referring to FIG. 6, the EL panel shown therein is the same as the EL panel of FIG. 2, except that an intermediate layer 7 formed of a conductive material is inserted in the EL layer 5. The intermediate layer 7 is in intimate contact at both major surfaces thereof with the EL layer 5. Referring to FIG. 7, the EL panel shown therein is the same as the EL panel of FIG. 3, except that an intermediate layer 7 formed of a conductive material is inserted in the EL layer 5. The intermediate layer 7 is in intimate contact at both major surfaces thereof with the EL layer 5.

Figure 8:
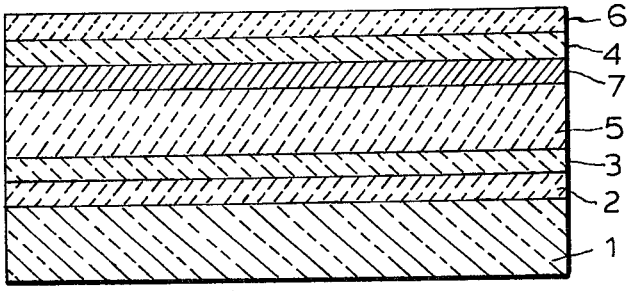

Referring to FIG. 8, the EL panel shown therein is the same as the EL panel of FIG. 1, except that an intermediate layer 7 formed of a conductive material is provided to be sandwiched between the EL layer 5 and the further insulating layer 4. The intermediate layer 7 is in intimate contact at one major surface thereof with the EL layer. The intermediate layer 7 in FIG. 8 can be sandwiched between the insulating layer 3 and the EL layer 5, instead of sandwiching the intermediate layer between the EL layer and the further insulating layer 4, although such structure is not shown in the figures.

Figure 9:
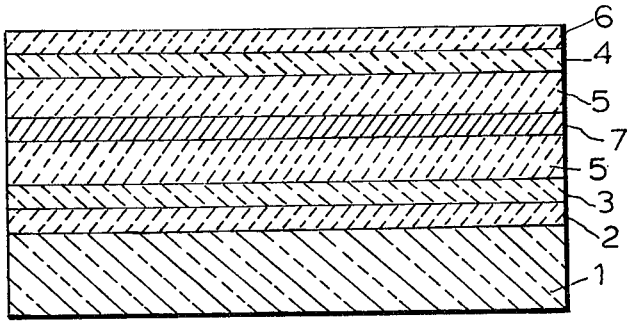

Referring to FIG. 9, the EL panel shown therein is basically the same as the EL panel of FIG. 1, except that an intermediate layer 7 formed of a conductive material is provided to be inserted in the a.c. EL layer 5. The intermediate layer is in intimate contact at both major surfaces thereof with the a.c. EL layer 5.

Figure 10:
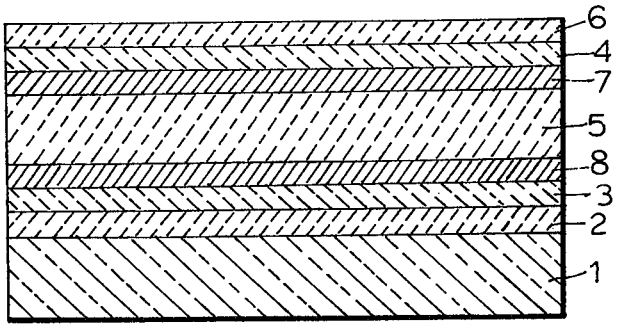

Referring to FIG. 10, the EL panel shown therein is the same as the EL panel of FIG. 8, except that a further intermediate layer 8 formed of a conductive material is sandwiched between the insulating layer 3 and the EL layer 5. The further intermediate layer 8 is in intimate contact at one major surface thereof with the EL layer 5.

In the EL panels of FIGS. 4 to 10, the intermediate layer 7 and the further intermediate layer 8 are not in direct contact with the electrodes 2 and 6. That is, the intermediate layers 7 and 8 are out of contact with the electrodes 2 and 6. The elements through which the lights emitted from the EL layer should pass are of course required to be transparent. Therefore, in the case of FIG. 10, for example, if the emitted lights should pass through the further intermediate layer 8, the insulating layer 3, the electrode 2 and the insulating substrate 1, these elements 8, 3, 2 and 1 are required to be transparent. Likewise, if the emitted lights should pass through the intermediate layer 7, the further insulating layer 4 and the electrode 6, these elements 7, 4 and 6 are required to be transparent. Such way of using transparent materials applies to the other examples also.

The preferred conductive materials to be used for the intermediate layer 7 and the further intermediate layer 8 are metals, conductive carbon and semiconductors. More specifically, it is preferred to employ, for the layers 7 and 8, at least one material from copper, silver, gold, zinc, cadmium, aluminum, indium, carbon, silicon, germanium, tin, lead, antimony, bismuth, selenium, tellurium, titanium, zirconium, niobium, tantalum, molybdenum, tungsten, manganese, rhodium, palladium, platinum, thorium, alloys of these metals, conductive carbon, conductive nitrides such as titanium nitride, and semiconductors such as zinc arsenide, cadmium arsenide, zinc antimonide, cadmium antimonide, silver sulfide, copper sulfide, aluminum antimonide, gallium arsenide, gallium phosphide, gallium antimonide, indium phosphide, indium arsenide, indium antimonide, indium oxide, tin oxide, titanium monoxide, zinc oxide, bismuth oxide, manganese dioxide, tungsten oxide, zinc selenide, zinc telluride, cadmium sulfide, cadmium selenide, cadmium telluride, copper iodide, silver iodide, lead sulfide, lead selenide, lead telluride, mercury telluride, tin sulfide and tin telluride. Among them, C, W, Au, Pd, Ta, Al, TiO, $In_2O_3$ and $SnO_2$ are more preferred.

The intermediate layers 7 and 8 can be applied by using electroless plating, vapor phase reaction, ion implantation and vacuum evaporation such as (1) arc discharge method, (2) electron beam heated evaporation, (3) resistance heated evaporation and (4) R.F. sputtering, etc. Among them, vacuum evaporation is more preferred, because the thickness of the conducting layers 7 and 8 can be more easily controlled thereby. To obtain an intimate contact between the intermediate layer and the layer in contact therewith, an annealing technique can preferably be used for treating the intermediate layer.

Preferred average thickness of each of the intermediate layers 7 and 8 is from 50 A to 5000 A from a practical point of view. If the intermediate layer is required to be transparent, the average thickness thereof is preferably less than 500 A.

Any available and suitable materials can be used for the electrodes 2 and 6. If the electrode is required to be transparent, it is preferred to use therefor tin oxide doped with antimony, indium oxide doped with tin or a thin metal (i.e. metal layer having a very small thickness to become transparent).

As for the insulating layers 3 and 4, it is preferred that they have a high breakdown voltage and a high uniformity. For example, each of the insulating layers 3 and 4 can be comprised of a material taken from silicon monoxide, silicon dioxide, tantalum oxide, titanium dioxide, aluminum oxide, silicon nitride, yttrium oxide, hafnium oxide and rare earth oxides such as cerium oxide. The preferred thickness of each of the insulating layers 3 and 4 is from 0.2 micron to 1.0 micron.

Any available and suitable EL materials can be used for the EL layer 5. For example, known ZnS containing an activator such as manganese, praseodymium, neodymium, samarium, europium, terbium, dysprosium, holmium, erbium, thulium, ytterbium, copper and silver can be used therefor. More preferable activators thereamong are manganese, samarium, europium, terbium, dysprosium, erbium and thulium. The preferred thickness of the EL layer 5 is from 0.2 micron to 8 microns. The preferred EL layer is a vacuum evaporated layer e.g. of ZnS plus an activator.

The insulating substrate 1 is not always necessary, but when it is used, materials which can be used therefor are, for example, glass, plastic films, etc.

Figure 11:
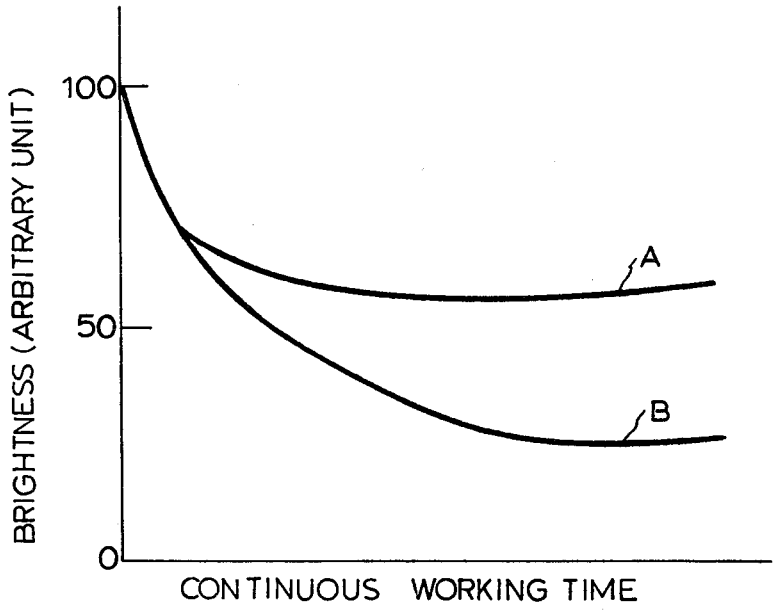
FIG. 11 is a graph qualitatively showing the change of relative brightnesses of EL panels of this invention and the prior art in an aging process.

It is the discovery of this invention that the brightness of the EL panel of this invention can be kept at a high level in the aging process, while the brightness of the conventional EL panel decreases greatly in the aging process. This can be more readily understood from FIG. 11. As apparent from FIG. 11, the brightnesses of both the conventional EL panel and the EL panel of this invention similarly decrease as time passes in an early portion of the continuous working time (early in aging process). However, soon thereafter, the brightness decreasing rate of the conventional EL panel becomes higher than that of this invention. The brightness of the EL panel of this invention can be kept at a level higher than 50 arbitrary units, while the brightness of the conventional EL panel soon becomes lower than the level of 50 arbitrary units, and continues to greatly decrease. When the aging process is accomplished, i.e. when the decrease of the brightness of the EL panels ceases, the brightness of the EL panel of this invention is higher than that of the conventional EL panel. The time required for the aging process in the case of this invention is shorter than that in the case of the conventional EL panel.

This difference in brightness characteristics is apparently attributable to the existence of the intermediate layer or layers. It is presumed that the EL layer in the EL panel of this invention can be supplied with much more free electron-carriers due to its intimate contact with the intermediate layer or layers than in the case where there is not provided any such intermediate layer.

According to this invention, it is not necessary that there only be one EL layer, but there can be provided two or more a.c. EL layers. Similarly, it is not necessary that there should be only one intermediate layer or only two intermediate layers, but there can be more than two intermediate layers.

The following Examples are given to illustrate certain details of this invention, and should not be construed as limitative.

EXAMPLE 1

EL panels corresponding to FIG. 1 and FIG. 8 were prepared as follows. Nineteen same glass substrates each having an electrode layer (tin oxide doped with antimony) were prepared. On each electrode layer, a 4000 A yttrium oxide insulating layer was vacuum evaporated. On each yttrium oxide layer, an EL layer of 8000 A thickness was vacuum evaporated by using ZnS containing 0.5 weight % of manganese as an evaporation source material.

Three of the nineteen EL layers were annealed in vacuum at 400° C for 2 hours. On one of the thus annealed three EL layers, a yttrium oxide layer of 4000 A thickness was vacuum evaporated, and on the thus formed yttrium oxide layer, an aluminum layer was vacuum evaporated. Thereby, a sample (Sample 1) corresponding to prior art (FIG. 1) was prepared. On the other two annealed EL layers, semitransparent silver sulfide and copper iodide were provided. The silver sulfide was provided by electroless plating. The copper iodide was provided by first vacuum evaporating copper on the annealed EL layer, and then exposing the vacuum evaporated copper to an iodine gas atmosphere to diffuse iodine into the copper. On each of the thus formed two intermediate layers, a yttrium oxide layer of 4000 A thickness was vaccum evaporated, and on the thus formed yttrium oxide layer, an aluminum layer was vacuum evaporated. Thereby, two samples (Samples 15 and 19) were prepared. On the other sixteen EL layers, intermediate layers listed in Table 1 having thicknesses listed in Table 1 were provided by the intermediate layer forming methods also listed in Table 1, respectively. Each of the sixteen EL layer plus intermediate layer combinations was annealed in vacuum at 400° C for 2 hours. On each of the thus formed sixteen intermediate layers, a yttrium oxide layer of 4000 A thickness was vacuum evaporated, and on the thus formed yttrium oxide layer, an aluminum layer was vacuum evaporated. Thereby, sixteen samples (Samples 2 to 14 and 16 to 18) were prepared. Samples 2 to 19 correspond to this invention (FIG. 8).

To these samples 1 to 19, a.c. pulses of 2 $kH_z$ having an amplitude of 250 V and a duty cycle of 0.4 were applied. All the samples thereby emitted orange color. By continuing the pulse voltage application, the brightness versus working time characteristics of samples 1 to 19 were measured.

Figure 12:
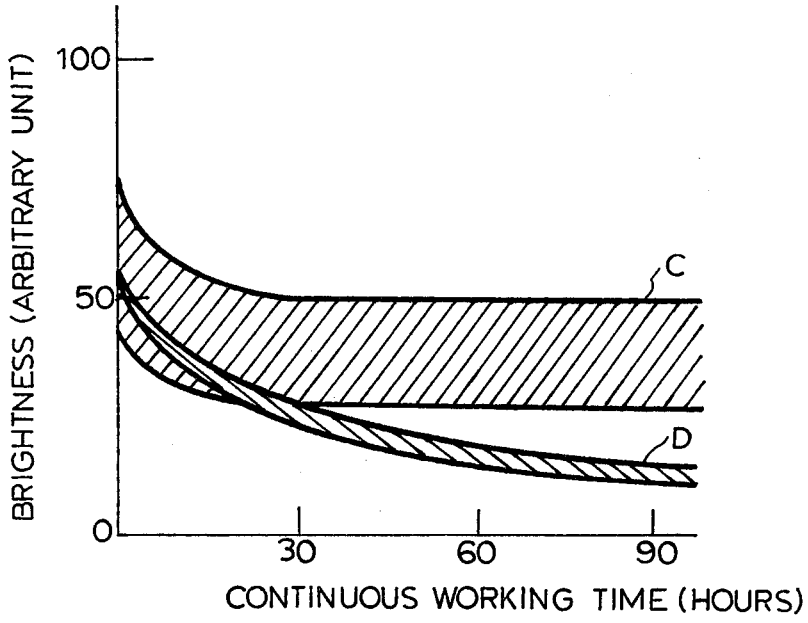
FIG. 12 is a graph showing the change of experimental relative brightnesses of EL panels of this invention and the prior art in an aging process.

FIG. 12 shows the results of the measurements, wherein the hatched region D is a region in which the brightness of Sample 1 fell, and the hatched region C is a region in which the brightness of Samples 2 to 19 fell. The initial brightness of Sample 1 was about 105 ft-L, and the brightness of Sample 1 measured 90 hours after the start of the voltage application was 35 ft-L. The brightness of Sample 1 was substantially constant 90 hours after the start of the voltage application. On the other hand, initial brightnesses of Samples 2 to 19 were between 85 ft-L and 170 ft-L, and the brightnesses of Samples 2 to 19 measured 90 hours after the start of the voltage application were between 60 ft-L and 90 ft-L. The brightnesses of Samples 2 to 19 were substantially constant 50 hours after the start of the voltage application. Table 1 shows, at the last column thereof, the brightnesses of Samples 1 to 19 measured 90 hours after the start of the voltage application. It is apparent from FIG. 12 and Table 1 that Samples 2 to 19 are superior to Sample 1. It is also apparent that Samples 3, 5, 6, 8, 9, 10 and 12 are particularly excellent.

Figure 14:
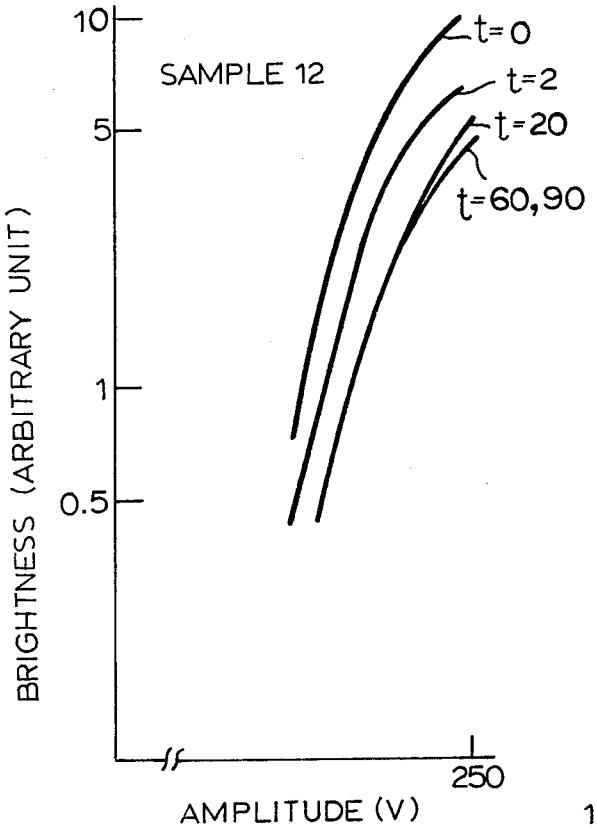
FIG. 14 is a graph showing the relative brightness vs. applied voltage characteristics of an EL panel according to this invention, measured at several points in time after the start of an aging process.
Figure 13:
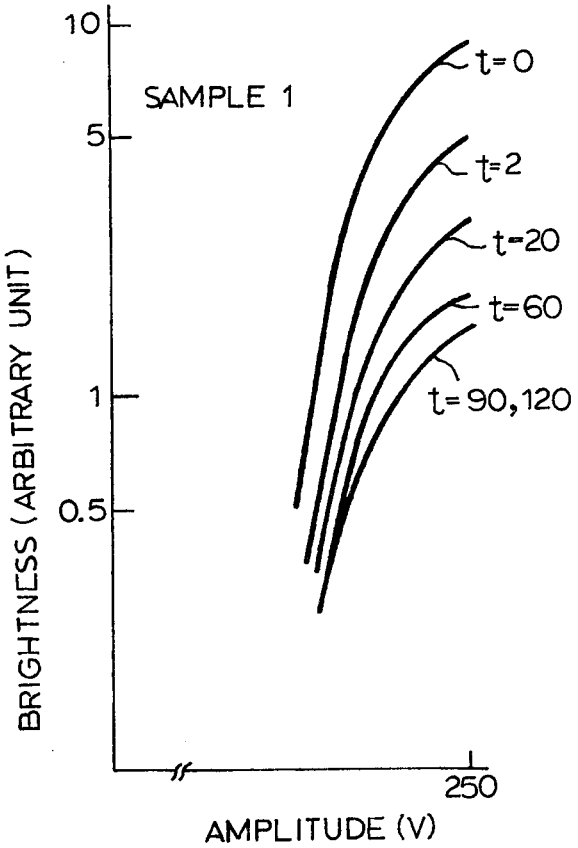
FIG. 13 is a graph showing the relative brightness vs. applied voltage characteristics of a conventional EL panel, measured at several points of time after the start of an aging process.

As to Samples 1 and 12, brightness versus amplitude (voltage) characteristics were also measured at several points in time after the start of the voltage application. FIGS. 13 and 14 show the results of the measurements, wherein "*t*" represents a point in time (hours).

EXAMPLE 2

EL panels corresponding to FIGS. 9 and 10 were prepared as follows. Two same glass substrates each having an electrode layer (tin oxide doped with antimony) were prepared. On each electrode layer, a cerium oxide layer of 4000 A thickness as an insulating layer was vacuum evaporated. On one of the two cerium oxide layers, an EL layer of 4000 A thickness was vacuum evaporated by using ZnS containing 0.5 weight % of manganese as an evaporation source material. On the thus formed EL layer, a titanium monoxide layer of 100 A thickness was vacuum evaporated. On the thus formed titanium monoxide layer, an EL layer of 4000 A thickness was vacuum evaporated by using ZnS containing 0.5 weight % of manganese as an evaporation source material. The thus made EL layer plus titanium monoxide layer combination was annealed in vacuum at 400° C for 2 hours. On the thus annealed second formed EL layer, a cerium oxide layer of 4000 A thickness was vacuum evaporated, and on the thus formed cerium oxide layer, an aluminum layer was vacuum evaporated. Thereby, a sample corresponding to FIG. 9 was prepared.

On the other cerium oxide layer formed on the electrode layer supported by the other glass substrate, a titanium monoxide layer of 100 A thickness was vacuum evaporated. On the thus formed titanium monoxide layer, an EL layer of 8000 A thickness was vacuum evaporated by using ZnS containing 0.5 weight % of manganese as an evaporation source material. On the thus formed EL layer, a titanium monoxide layer of 100 A thickness was vacuum evaporated. The thus made EL layer plus titanium monoxide layer combination was annealed in vacuum at 400° C for 2 hours. On the thus annealed second formed titanium monoxide layer, a cerium oxide layer of 4000 A thickness was vacuum evaporated, and on the thus formed cerium oxide layer, an aluminum layer was vacuum evaporated. Thereby, a sample corresponding to FIG. 10 was prepared.

Both of the thus made samples emitted orange color upon being supplied with a.c. pulses of 2 $kH_Z$ having an amplitude of 250 V and a duty cycle of 0.4. Upon being subjected to an aging process by the a.c. pulses, both samples exhibited brightnesses falling within the hatched region C in FIG. 12, and the brightnesses of both samples were substantially constant after the time point of 50 hours after the start of the voltage application.

EXAMPLE 3

One EL panel corresponding to FIG. 2 and eighteen EL panels corresponding to FIG. 4 were prepared as follows. The sample EL panel corresponding to FIG. 2 was prepared in a manner similar to that used for preparing Sample 1 in EXAMPLE 1, except that here the EL layer was formed directly on the electrode layer formed on the glass substrate without using the first yttrium oxide layer and by using ZnS containing 0.1 weight % of manganese as the evaporation source material, the annealing was carried out at 300° C for 15 minutes. A vacuum evaporated cerium oxide layer of 6000 A thickness was used instead of the yttrium oxide layer of 4000 A thickness formed in EXAMPLE 1 on the EL layer.

On the other hand, the eighteen sample EL panels corresponding to FIG. 4 were prepared in a manner similar to that used for preparing Samples 2 to 19 in EXAMPLE 1, except that here the EL layer was formed directly on the electrode layer formed on the glass substrate without using the yttrium oxide layer and by using ZnS containing 0.1 weight % of manganese as the evaporation source material, the annealing was carried out at 300° C for fifteen minutes (except samples corresponding to Samples 15 and 19 which did not use annealing), and a vacuum evaporated cerium oxide layer of 6000 A thickness was used instead of the yttrium oxide layer of 4000 A thickness formed in EXAMPLE 1 on the conducting layer.

To these nineteen samples, a.c. pulses of 2 $kH_Z$ having an amplitude of 160 V and a duty cycle of 0.4 were applied. All of the samples thereby emitted orange color. By continuing the pulse voltage application, the brightness versus working time characteristics of the nineteen samples were measured.

The characteristics of the sample corresponding to FIG. 2 fell within the hatched region D in FIG. 12, whereas the characteristics of the other eighteen samples corresponding to FIG. 4 fell within the hatched region C in FIG. 12. Initial brightness of the sample corresponding to FIG. 2 was about 30 ft-L, and the brightness thereof measured at a time point of 90 hours after the start of the voltage application was about 10 ft-L. On the other hand, intitial brightnesses of the other eighteen samples were between 20 ft-L and 45 ft-L, and the brightnesses thereof at a time point of 90 hours after the start of the voltage application were between 15 ft-L and 20 ft-L. The brightnesses of these eighteen samples were substantially constant after the time point of 50 hours after the start of the voltage application.

EXAMPLE 4

An EL panel corresponding to FIG. 6 was prepared in a manner similar to that used for preparing the sample corresponding to FIG. 9 in EXAMPLE 2, except that here the first EL layer was formed directly on the electrode layer without using the first cerium oxide layer, the first and the second EL layers were formed by using ZnS containing 0.1 weight % of manganese as an evaporation source material, the annealing was carried out at 300° C for 15 minutes, and a yttrium oxide layer of 6000 A thick was used instead of the second cerium oxide layer.

The thus made sample EL panel emitted an orange color upon being supplied with a.c. pulses of 2 $kH_Z$ having an amplitude of 160 V and a duty cycle of 0.4, and had brightness versus working time characteristics falling within the hatched region C in FIG. 12 upon being continuously supplied with the a.c. pulses. The brightness of the sample was substantially constant 50 hours after the start of the voltage application.

EXAMPLE 5

Seven EL panels corresponding to FIG. 1 were prepared in a manner similar to that used for preparing Sample 1 in EXAMPLE 1, except that here 0.5 weight % of samarium, 0.5 weight % of erbium, 0.5 weight % of terbium, 0.5 weight % of dysprosium, 0.5 weight % of thulium, 0.5 weight % of europium and 0.5 weight % of erbium plus terbium (0.25 weight % of erbium plus 0.25 weight % of terbium) were used, respectively, instead of 0.5 weight % of manganese used in EXAMPLE 1 to be contained in ZnS. Similarly, seven EL panels corresponding to FIG. 8 were prepared in a manner similar to that used for preparing Sample 8 in EXAMPLE 1, except that here 0.5 weight % of samarium, 0.5 wt. % of erbium, 0.5 wt. % of terbium, 0.5 weight % of dysprosium, 0.5 weight % of thulium, 0.5 weight % of europium and 0.5 weight % of erbium plus terbium (0.25 weight % of erbium plus 0.25 weight % of terbium) were used, respectively, instead of 0.5 weight % of manganese used in EXAMPLE 1 to be contained in ZnS.

Upon being supplied with a.c. pulses of 2 $kH_Z$ having an amplitude of 250 V and a duty cycle of 0.4, these sample EL panels emitted colors as listed in Table 2 in correspondence with the kinds of activators. By continuing the voltage application, the brightnesses of these fourteen samples were measured. The thus measured brightness versus working time characteristics of the here made seven samples corresponding to FIG. 1 fell substantially within the hatched region D in FIG. 12, while those of the here made seven samples corresponding to FIG. 8 fell within the hatched region C in FIG. 12. Each of the samples respectively using 0.5 weight % of erbium and 0.5 weight % of samarium and corresponding to FIG. 1, for example, had a brightness of about 5 ft-L at 90 hours after the start of the voltage application, whereas the samples respectively using 0.5 weight % of erbium and 0.5 weight % of samarium and corresponding to FIG. 8, for example, had brightnesses between 10 ft-L and 20 ft-L at a time point of 90 hours after the start of the voltage application. The brightnesses of all the here made seven samples corresponding to FIG. 8 were substantially constant 50 hours after the start of the voltage application.

Table 1

| Sample No. | Material of intermediate layer | Thickness of intermediate layer | Working characteristics in FIG. 12 | Intermediate layer forming method | Brightness at 90 hours after voltage appln. in EXAMPLE 1 (ft-L) |
|---|---|---|---|---|---|
| 1 | — | — | D | — | 35.2 |
| 2 | C | 200 A | C | arc discharge method | 79.3 |
| 3 | W | semi-transparent | C | electron beam heated evap. | 83.7 |
| 4 | Au | 150 A | C | resistance heated evap. | 80.0 |
| 5 | Pd | 100 A | C | resistance heated evap. | 84.0 |
| 6 | Ta | semi-transparent | C | electron beam heated evap. | 86.5 |
| 7 | Ge | 200 A | C | resistance heated evap. | 67.3 |
| 8 | Pt | 150 A | C | electron beam heated evap. | 86.0 |
| 9 | Mo | 200 A | C | electron beam heated evap. | 82.1 |
| 10 | tin nitride | 150 A | C | R.F. Sputtering | 85.5 |
| 11 | Al | 100 A | C | resistance heated evap. | 80.0 |
| 12 | titanium monoxide | 100 A | C | resistance heated evap. | 89.2 |
| 13 | indium oxide | 300 A | C | resistance heated evap. | 65.8 |
| 14 | tin oxide | 250 A | C | R.F. sputtering | 73.0 |
| 15 | silver sulfide | semi-transparent | C | electroless plating | 61.2 |
| 16 | indium antimonide | 100 A | C | resistance heated evap. | 68.7 |
| 17 | cadmium arsenide | 100 A | C | resistance heated evap. | 69.3 |
| 18 | cadmium sulfide | 250 A | C | resistance heated evap. | 71.2 |
| 19 | copper iodide | semi-transparent | C | Cu evap. + iodine diffusion | 59.0 |

EXAMPLE 6

Seven EL panel corresponding to FIG. 2 were prepared in a manner similar to that used for preparing the sample corresponding to FIG. 2 in EXAMPLE 3, except that here the activator (manganese) was replaced by other activators in a manner similar to that in EXAMPLE 5. Also seven EL panels corresponding to FIG. 4 were prepared in a manner similar to that used in EXAMPLE 3 for preparing the sample corresponding to FIG. 4 and to Sample 8 of EXAMPLE 1, except that here the activator (manganese) was replaced by other activators in a manner similar to that in EXAMPLE 5.

Upon being supplied with a.c. pulses of 2 $kH_Z$ having an amplitude of 160 V and a duty cycle of 0.4, the here made fourteen samples emitted colors as listed in Table 2 in correspondence with the kinds of activators. By continuing the voltage application, the brightnesses of these fourteen samples were measured. The measured brightness versus working time characteristics of the here made seven samples corresponding to FIG. 2 fell substantially within the hatched region D in FIG. 12, while those of the here made seven samples corresponding to FIG. 4 fell within the hatched region C in FIG. 12.

Table 2

| Activator for activating ZnS | Color of electro-luminescence |
|---|---|
| samarium | red-orange |
| erbium | green |
| terbium | green |
| dysprosium | yellow |
| thulium | blue |
| europium | pink |
| erbium plus terbium | green |

What is claimed is:

1. An electroluminescent panel comprising a first electrode which is transparent, a second electrode and a multi-layer which is in intimate contact with and is sandwiched between said electrodes, said electrodes being adapted to receive a voltage therebetween, said multi-layer comprising in the following order:

(a) an insulating layer which is in contact with one of said electrodes, (b) an A.C. electroluminescent layer which is in contact with said insulating layer, (c) an intermediate layer formed of a conductive material and (d) a further A.C. electroluminescent layer, said intermediate layer being in intimate contact at both major surfaces thereof with said electroluminescent layers, whereby when said electroluminescent layer is supplied with a voltage between said first and second electrodes and said electroluminescent layer emits lights from said electroluminescent panel through said first electrode.

2. An electroluminescent panel according to claim 1, wherein said insulating layer is transparent and is in contact with said first electrode.

3. An electroluminescent panel according to claim 1, wherein said electroluminescent layer is in contact with said first electrode.

4. An electroluminescent panel comprising a first electrode which is transparent, a second electrode and a multi-layer which is in intimate contact with and is sandwiched between said electrodes, said electrodes being adapted to receive a voltage therebetween, said multi-layer comprising in the following order:

(a) an insulating layer which is in contact with one of said electrodes,
(b) an A.C. electroluminescent layer,
(c) an intermediate layer formed of a conductive material,
(d) a further A.C. electroluminescent layer,
(e) a further insulating layer, in contact with the other of said electrodes, said intermediate layer being in intimate contact at both major surfaces thereof with said electroluminescent layers, whereby when said electroluminescent layer is supplied with a voltage between said first and second electrodes, said electroluminescent layer emits lights from said electroluminescent panel through said first electrode.

5. An electroluminescent panel according to claim 4, wherein said insulating layer is transparent and is in contact with said first electrode.

6. An electroluminescent panel comprising a first electrode which is transparent, a second electrode and a multi-layer which is in intimate contact with and is sandwiched between said electrodes, said electrodes being adapted to receive a voltage therebetween, said multi-layer comprising in the following order:

(a) an insulating layer in contact with one of said electrodes,
(b) an intermediate layer formed of a conductive material,
(c) an A.C. electroluminescent layer,
(d) a further intermediate layer formed of a conductive material,
(e) a further insulating layer in contact with the other of said electrodes, said intermediate layers being in intimate contact with said electroluminescent layer, whereby when said electroluminescent layer is supplied with a voltage between said first and second electrodes, said electroluminescent layer emits lights from said electroluminescent panel through said first electrode.

7. An electroluminescent panel according to claim 6, wherein said further intermediate layer is transparent, and said insulating layer is transparent and is in contact with said first electrode.

* * * * *